US006199214B1

(12) United States Patent
Campbell

(10) Patent No.: US 6,199,214 B1
(45) Date of Patent: Mar. 13, 2001

(54) HEADGEAR VENTILATION DEVICE

(76) Inventor: Donald Alban Campbell, Lyncroft, 2 Vicarage Hill, Dartmouth, Devon TQ6 9EW (GB)

( * ) Notice: Subject to any disclaimer, the term of this patent is extended or adjusted under 35 U.S.C. 154(b) by 0 days.

(21) Appl. No.: 09/398,615

(22) Filed: Sep. 17, 1999

(30) Foreign Application Priority Data

Sep. 25, 1998 (GB) ..... 9820799
Dec. 8, 1998 (GB) ..... 9826929

(51) Int. Cl.[7] ..... A42C 5/00

(52) U.S. Cl. ..... 2/181.6; 2/181.8; 34/66; 34/99

(58) Field of Search ..... 34/524, 60, 62, 34/66, 68, 71, 80, 96, 99; 2/7, 10, 172, 181, 181.2, 181.4, 181.6, 181.8, 184, 195.6

(56) References Cited

U.S. PATENT DOCUMENTS

Re. 29,452 * 10/1977 Townsend, Jr. ..... 2/177
3,897,597 * 8/1975 Kasper ..... 2/9
4,274,157 * 6/1981 Boden ..... 2/181.4
4,390,998 * 7/1983 Gallin ..... 2/180
5,313,668 * 5/1994 Bogan et al. ..... 2/181.4
5,365,607 * 11/1994 Benevento, Jr. et al. ..... 2/181.4
5,481,760 * 1/1996 Wood, Jr. ..... 2/195.5
5,625,901 * 5/1997 Healy ..... 2/182.2
5,787,507 * 8/1998 Sullivan ..... 2/182.1
5,920,910 * 7/1999 Calvo ..... 2/181.4

* cited by examiner

*Primary Examiner*—Stephen Gravini
(74) *Attorney, Agent, or Firm*—Ira S. Dorman

(57) ABSTRACT

A plastics molding includes an elongate flexible strip 3 and a plurality of substantially flat wall sections 5 disposed in an end-to-end, mutually spaced relationship, lying substantially on a smooth curve which meets the strip at opposite ends. The wall sections 5 are connected to the flexible strip at their opposite ends by means of webs 8, 9 such as to form trapezoidal ventilation passages 10 between the wall sections and the flexible strip. The webs may contain ventilation apertures. In different embodiments the molding may be curved such that the flexible wall lies on the inside or the outside. The inside wall is covered with a porous sweat band 12 and contains apertures 7 so that air flowing through the ventilation passages 10 keeps the sweat band dry by a wick effect. The outside wall is provided with a layer of pressure-sensitive adhesive for attaching the device to the inside of the headgear.

15 Claims, 3 Drawing Sheets

HEADGEAR VENTILATION DEVICE

TECHNICAL FIELD OF THE INVENTION

This invention relates to a ventilation device for use with headgear such as hats, caps or helmets.

BACKGROUND

In hot climates, and during spells of hot weather in temperate climates, it is common for people to wear headgear to provide protection and shading from the sun. Some people are also required to wear headgear for reasons connected with their work. Whilst there are proven benefits in wearing headgear in sunny weather, e.g. increased protection against skin cancer, the advantages are offset by the fact that a substantially enclosed air space is formed between the bowl of the hat and the wearers head. This space can entrap hot and humid air which causes the wearers head to become hot and the wearer to become extremely uncomfortable.

Items of headgear are sometimes formed with ventilation openings, but in general these are too small to provide effective ventilation. In GB 411 707 the ventilation openings are covered by a hat band 4.

WO 94/09658 discloses means for ventilating and stabilising headgear in the form of a flexible strip having, on one side, means of attachment to the headgear, and on its other side, a plurality of resilient or flexible spacers for spacing the headgear from a wearers head. A similar arrangement is disclosed in U.S. Pat. No. 5,625,901.

GB 485 873, GB 713 851 and U.S. Pat. No. 4,274,157 all disclose a continuous sweat band which is held away from the inside of the hat by means of spacers.

The present invention seeks to provide a new and inventive form of ventilation device for headgear.

SUMMARY OF THE INVENTION

The present invention proposes a ventilation device for attachment to an article of headgear, said ventilation device comprising:

an elongate flexible strip; and a plurality of substantially flat wall sections disposed in an end-to-end mutually spaced relationship and lying substantially on a smooth curve which meets the flexible strip at opposite ends thereof, each of said wall sections being connected at opposite ends to the flexible strip such as to form a ventilation passage between the respective wall section and the flexible strip.

When the device is secured inside the rim of an item of headgear, air can flow through the ventilation space to effectively ventilate the interior of the headgear without significantly increasing the required size of the headgear or making the headgear uncomfortable to wear. The curvature of the ventilation device can be varied over a wide range allowing a single device to be used with a wide ranges of shapes and sizes of headgear.

The wall sections are preferably connected to the flexible strip by a pair of spacer walls which join opposite ends of the respective wall section to the flexible strip. The spacer walls preferably diverge towards the flexible strip so that the device provides the wearer with firm support.

The device preferably comprises a plastics moulding.

The inner wall of the device preferably comprises a plurality of apertures so that air flowing through the ventilation spaces can assist in the evaporation of moisture from the wearers skin. The inner wall is preferably covered by a layer of flexible moisture-absorbing porous material for contact with the wearers skin. The material aids removal of moisture by a wick effect, which is in turn assisted by increased evaporation due to air flow through the ventilation space.

The outer surface preferably comprises means for attachment to the inside of a hat, which preferably comprises a layer of pressure-sensitive adhesive. Prior to use, the layer may be protected by a peelable backing.

The inner and outer wall s of the device may be transversely raked for increased comfort.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
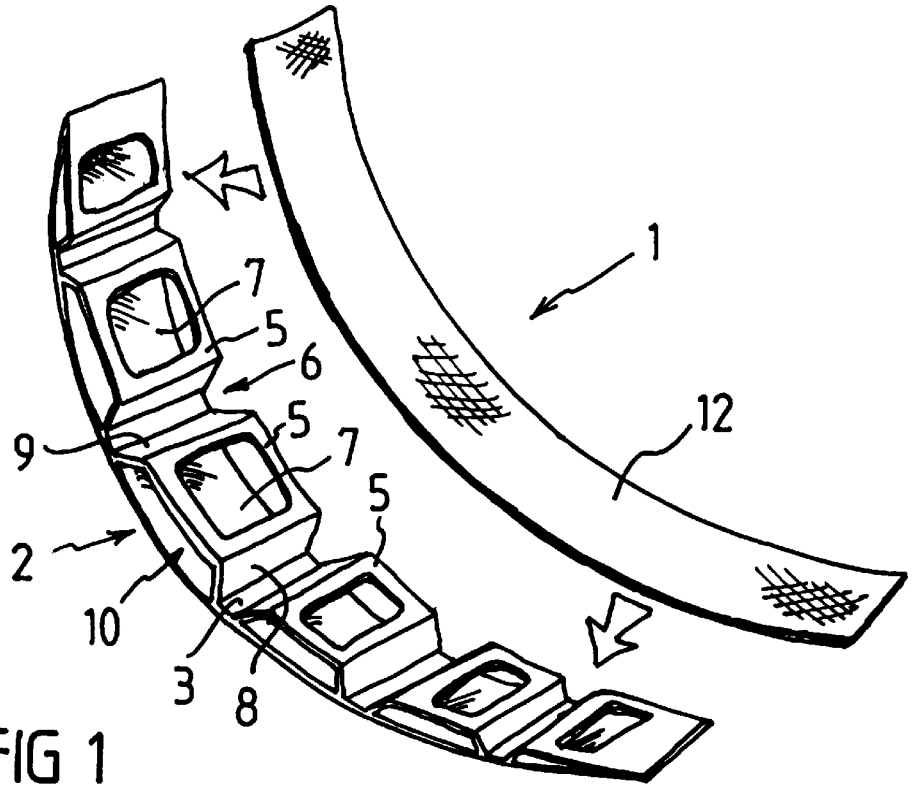
FIG. 1 is a general perspective view of a ventilation device in accordance with the invention, shown in two separate parts for convenience of illustration.
Figure 2:
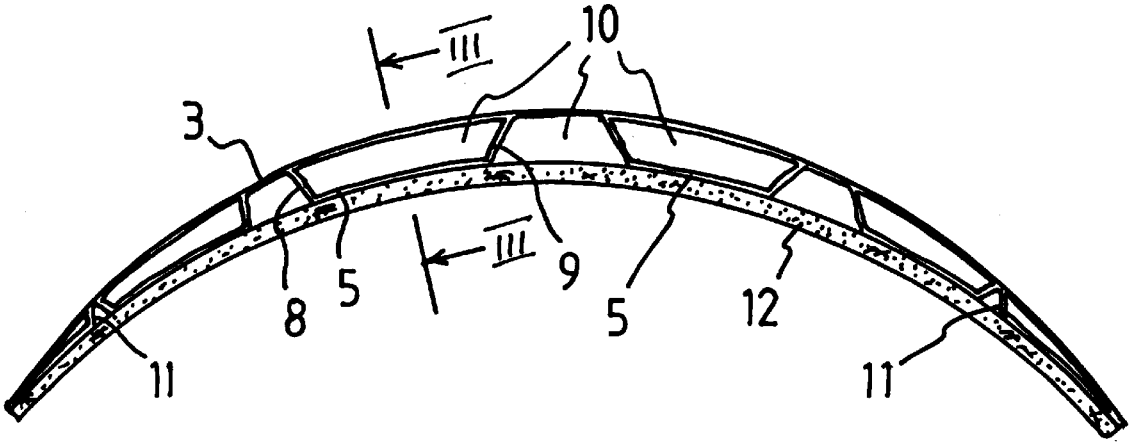
FIG. 2 is a top plan view of the device.

Referring firstly to FIGS. 1 and 2, the ventilation device 1 comprises a plastics moulding 2 which could either be moulded straight and formed into a crescent prior to use or moulded in an inherent crescent shape. The moulding includes an outer wall 3 in the form of an elongate rectangular strip which is substantially continuous, although it could contain apertures if desired. The moulding further includes a series of substantially flat inner wall sections 5 which are disposed end-to-end in a mutually spaced relationship to lie on a smooth arc. The radius of curvature of the arc formed by the inner wall sections 5 is greater than that of the outer wall 3, i.e. the inner wall sections form a more gentle curve, so that the two outer wall sections 5 meet the inner wall 3 at opposite ends of the moulding.

The wall sections 5 are thus separated by gaps 6. In addition, each section 5 contains a window 7 so that the windows 7 and gaps 6 allow air and moisture to pass through and between the inner wall sections. In fact, the wall sections could each contain a large number of holes, and may even be formed like a mesh. In general, each section 5 is joined to the outer wall 3 at opposite ends by respective webs 8 and 9. In this example the webs diverge towards the outer wall 3 so that substantially trapezoidal ventilation passages 10 are formed between the wall sections 5 and the inner wall 3. The webs 8 and 9 can be solid as shown but they could also contain ventilation apertures to improve air flow through and between the passages 10. It will be appreciated that the passages 10 could be of any suitable cross-sectional shape, although the trapezoidal configuration is preferred since it makes the moulding very firm even with relatively thin wall sections whilst allowing the curvature of the device to be varied over a wide range for use with many different sizes and shapes of hat.

Since the two end sections 5 are already joined to the front wall 3 at each end of the device they only have one web 11 which connects the opposite edge to the outer wall 3. Thus, the two end passages are substantially triangular rather than trapezoidal.

Figure 3:
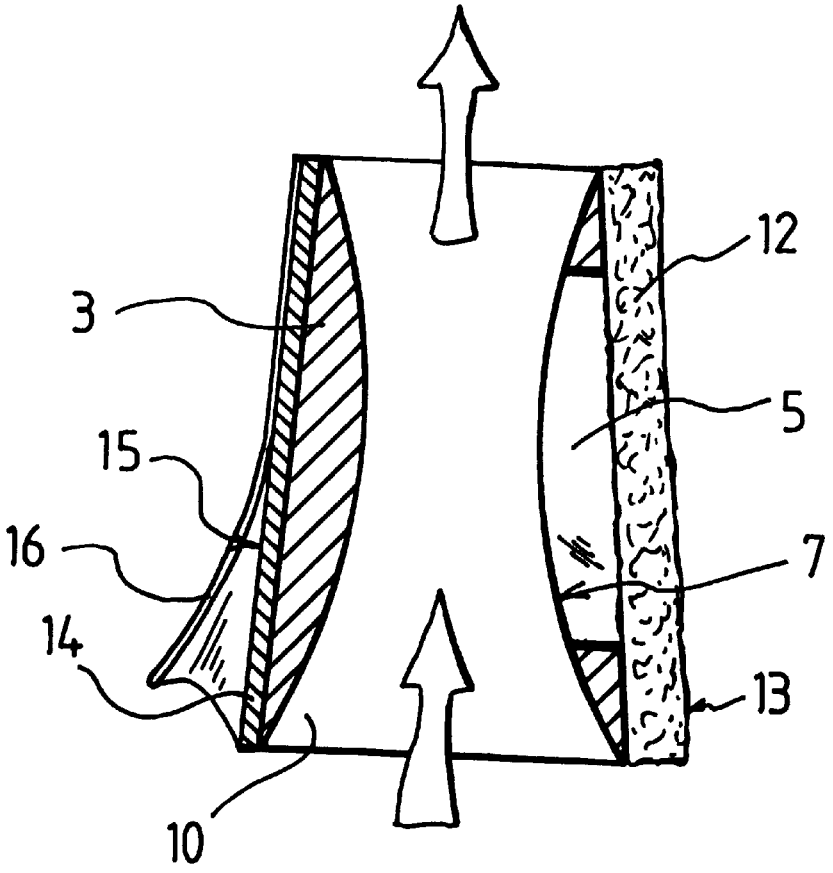
FIG. 3 is transverse section III—III of FIG. 2.

Referring to FIG. 3, the two walls 3 and 5 may be raked slightly (say at an angle of about 10°) towards one longitudinal edge of the device which will be uppermost in use. In addition, the front and rear walls could be slightly wing-shaped as shown, to promote better air flow through the passages 10.

A soft and flexible moisture-absorbent porous strip forming a sweat band 12 is secured to the inner wall sections 5, e.g. by means of an adhesive, for contact with the head of a user. By way of example, the strip may comprise a network of synthetic or natural fibres, e.g. cotton, which absorb moisture (perspiration) from the head. The strip 12 may be adhesively secured to the wall sections 5 after the moulding 2 has been bent to the required curvature, forming a substantially continuous inner surface, although the strip could be formed in sections which are individually applied to the sections 5.

The outer wall 3 is externally covered with a layer of pressure-sensitive adhesive 14 (FIG. 3) which thus provides an arcuate outer attachment surface 15. The adhesive layer 14 is, in turn, covered by a peelable backing layer 16 prior to use.

Figure 4:
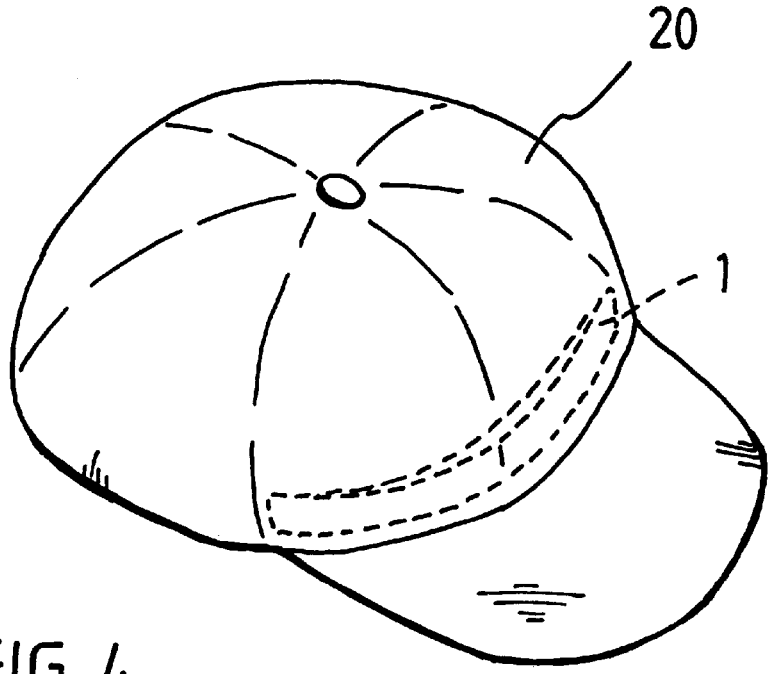
FIG. 4 is a general view of the device inserted into a cap.

The device can be affixed to an item of headgear such as a cap 20 as shown in FIG. 4. To apply the device the backing layer 16 is peeled off to expose the adhesive layer 14 which is used to affix the device just inside the rim of the cap. Due to the gaps between the wall sections 5 the device is inherently flexible such that its curvature can be changed to accommodate different shapes and sizes of cap and conform to the shape of a wearers head.

Figure 5:
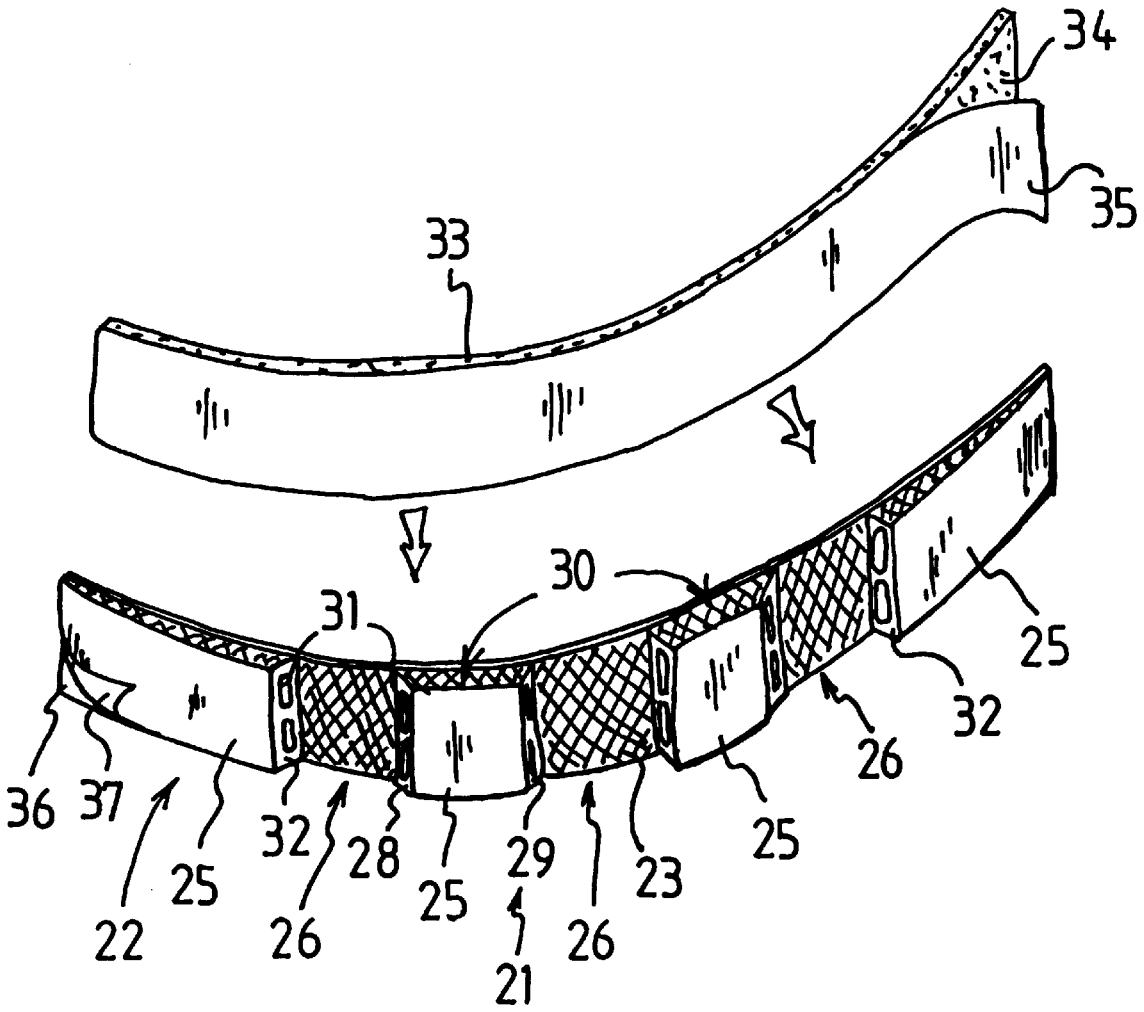
FIG. 5 is a general perspective view of another form of the ventilation device.

The device acts as a spacer between the rim of the cap and the head so that the passages 10 allow air to flow into the bowl of the cap and ventilate the space between the head and the cap (see FIG. 5). Generation of heat inside the cap helps to draw air in through the device and therefore aids ventilation. The sweat band 12 absorbs moisture from the head of the wearer which travels across the thickness of the porous strip by a wick effect. The air flow through the passages 10 increases the rate of evaporation of moisture at the wall 5 and ensures that the strip 12 and forehead of the wearer are thus kept completely dry and comfortable in use.

The device will generally be affixed at the front of the headgear for maximum comfort and ventilation, although it could also be fixed at the side or rear, or two such devices could be secured on opposite sides of the cap, or at front and rear, to provide for a through-flow of air and further assist ventilation.

The maximum distance between the outer and inner walls 3 and 5 will usually be no more than 5 or 6 mm. In the case of adjustable headgear the size can be increased slightly to accommodate the ventilation device, but in many cases there will be no need to use a larger size of headgear than normal.

The crescent-like shape of the ventilation device together with the substantially flat wall sections 5 greatly enhances comfort so that the wearer will not generally be aware that the device is in place, but on the other hand, the ventilation provided by the device means that the overall comfort of the headgear is greatly improved even in very hot weather.

The moisture-absorbent layer 12 can be replaced when it becomes soiled, being secured to the inner wall 5 by means of a releasable adhesive layer.

A second form of the ventilation device is shown in FIG. 5. The device 21 again comprises a plastics moulding 22 which could either be moulded straight or curved. The moulding includes an elongate inner wall 23 which is formed with numerous apertures. The moulding includes a series of substantially planar outer wall sections 25 disposed end-to-end and separated by gaps 26 to lie on a smooth curve which meets the wall 23 at opposite ends of the moulding. The wall sections 25 may be solid a shown, or they may contain apertures. Each section 25 is joined to the inner wall 23 by webs 28 and 29 which diverge towards the inner wall 23 so that substantially trapezoidal ventilation passages 30 are formed between the wall sections 25 and the wall 23. The webs 28 and 29 could be solid but they preferably contain ventilation apertures 31 to improve air flow through and between the passages 30. The two end wall sections 25 only have a single web 32, being joined to the front wall 23 at opposite ends of the moulding. Again, the walls 23 and 25 are raked at an angle of about 10° and they could be slightly wing-shaped as in FIG. 3.

A soft and flexible moisture-absorbent porous strip of synthetic or natural fibres forms a sweat band 33 for attachment to the inner wall 23 by means of an adhesive layer 34. Again, the strip 33 is preferably replaceable, the adhesive being protected prior to use by a peelable backing 35. The outer wall sections 25 are externally covered with layers of pressure-sensitive adhesive 36 covered by a peelable backing layer 37 prior to use, for attaching the device inside the rim of an item of headgear. Due to the gaps 26 between the wall sections 25 the device is inherently flexible such that its curvature can be changed to accommodate different sizes of hat or cap.

The embodiments described above can thus be used with a wide range of shapes and sizes of headgear. The devices are firm and very comfortable for the wearer, and provide highly effective ventilation.

What I claim is:

1. A ventilation device for attachment to a generally curved interior surface of an article of headgear, said ventilation device comprising:

an elongate flexible strip; and a plurality of substantially flat wall sections disposed in an end-to-end mutually spaced relationship, at least when so attached to such an article of headgear said flexible strip lying generally on a first arc and said wall sections lying substantially on a second arc having a radius of curvature different than the radius of curvature of said first arc and meeting said first arc at opposite ends of said flexible strip each of said wall sections being connected at opposite ends to said flexible strip, such as to form a ventilation passage between the respective wall section and said flexible strip.

2. A ventilation device according to claim 1, comprising wall sections which are connected to said flexible strip by a pair of spacer walls which join opposite ends of a respective wall section to a flexible strip.

3. A ventilation device according to claim 2, in which said spacer walls diverge towards said flexible strip.

4. A ventilation device according to claim 1, in which said wall sections are transversely raked relative to said flexible strip.

5. A ventilation device according to claim 1, in which said flexible strip and said wall sections comprise a single plastics moulding.

6. A ventilation device according to claim 1, in which said wall sections contain apertures.

7. A ventilation device according to claim 1, in which said wall sections are covered by a layer of flexible moisture-absorbing porous material for contact with a wearers skin.

8. A ventilation device according to claim 1, in which said flexible strip comprises means for attachment to the inside of a hat.

9. A ventilation device according to claim 8, in which said means for attachment comprises a layer of pressure-sensitive adhesive.

10. A ventilation device according to claim 9, in which said layer of pressure-sensitive adhesive is protected by a peelable backing.

11. A ventilation device according to claim 1, in which said flexible strip contains apertures.

12. A ventilation device according to claim 1, in which said flexible strip is covered by a layer of flexible moisture-absorbing porous material for contact with a wearers skin.

13. A ventilation device according claim 1, in which said wall sections comprise means for attachment to the inside of a hat.

14. A ventilation device according to claim 13, in which said means for attachment comprises a layer of pressure-sensitive adhesive.

15. A ventilation device according to claim 14, in which said layer of pressure-sensitive adhesive is protected by a peelable backing.

* * * * *